US007080009B2

(12) United States Patent
Proctor et al.

(10) Patent No.: US 7,080,009 B2
(45) Date of Patent: Jul. 18, 2006

(54) METHOD AND APPARATUS FOR REDUCING RATE DETERMINATION ERRORS AND THEIR ARTIFACTS

(75) Inventors: Lee M Proctor, Cary, IL (US); Mark D Hetherington, Crystal Lake, IL (US); Nai S Wong, Palatine, IL (US); William K Morgan, Elgin, IL (US)

(73) Assignee: Motorola, Inc., Schaumburg, IL (US)

( * ) Notice: Subject to any disclaimer, the term of this patent is extended or adjusted under 35 U.S.C. 154(b) by 680 days.

(21) Appl. No.: 09/767,522

(22) Filed: Jan. 23, 2001

(65) Prior Publication Data

US 2003/0182108 A1 Sep. 25, 2003

(51) Int. Cl.
*G10L 19/00* (2006.01)
*G10L 19/14* (2006.01)

(52) U.S. Cl. ..... 704/221; 704/223; 375/225

(58) Field of Classification Search ..... 704/221, 704/223, 224, 225, 229; 375/341, 225
See application file for complete search history.

(56) References Cited

U.S. PATENT DOCUMENTS 4,617,676 A * 10/1986 Jayant et al. ..... 704/212
4,618,982 A * 10/1986 Horvath et al. ..... 704/219
5,414,796 A * 5/1995 Jacobs et al. ..... 704/221
5,657,420 A 8/1997 Jacobs et al.
5,751,725 A * 5/1998 Chen ..... 714/708
5,835,889 A 11/1998 Kapanen
5,870,405 A 2/1999 Hardwick et al.
6,092,230 A 7/2000 Wood et al.
6,141,353 A * 10/2000 Li ..... 370/465
6,205,130 B1 * 3/2001 DeJaco ..... 370/335
6,397,177 B1 * 5/2002 Isabelle ..... 704/221
6,584,438 B1 * 6/2003 Manjunath et al. ..... 704/228
6,804,218 B1 * 10/2004 El-Maleh et al. ..... 704/223

* cited by examiner

*Primary Examiner*—David Hudspeth
*Assistant Examiner*—James S. Wozniak
(74) *Attorney, Agent, or Firm*—Kenneth A. Haas; Jeffrey K. Jacobs

(57) ABSTRACT

The present invention provides a method and apparatus for improving the audio quality of a signal by reducing the effect of mis-determining the frame rate of a frame. The method includes the steps of determining that the frame rate of the current frame of information is eighth rate (324/340), determining that the previous frame was a full rate frame (334) and resetting the filter states of a speech decoder (336). The method further comprises the steps of utilizing alternative symbol error thresholds based on the number of consecutive frames with the same frame rate (308/328).

14 Claims, 6 Drawing Sheets

METHOD AND APPARATUS FOR REDUCING RATE DETERMINATION ERRORS AND THEIR ARTIFACTS

FIELD OF THE INVENTION

The present invention relates generally to communication systems, and more particularly, the present invention relates to a method and apparatus for reducing rate determination errors in a communication system, as well as mitigating the audio artifacts resulting from any remaining rate determination errors.

BACKGROUND OF THE INVENTION

Within a Code Division Multiple Access (CDMA), and other communication system types, communicated information, either voice or data, is carried between communication resources, e.g., a radio telephone and a base station, on a communication channel. Within broadband, spread spectrum communication systems, such as CDMA based communication systems in accordance with Interim Standard IS-95B, a spreading code is used to define the communication channel.

CDMA systems have the capability of transmitting user information at variable rates. For example in voice calls the data rate of each speech frame is varied based on the speech activity. When a user is speaking, compressed speech information is typically sent at full rate. Between words and sentences the data rate is typically reduced to eighth rate. Half and quarter rates are also used for speech to quiet transitions and when data rate reductions are required, such as to allow for multiplexing of signaling information or to increase system capacity. In data services calls, full, half, quarter and eighth rate frames can be selected based on the data rate of the user requested information.

To protect against data corruption on the air interface, mobile communication systems typically employ Forward Error Correction techniques. In the base site to mobile subscriber unit direction, deemed the forward link, IS-95 includes the addition of Cyclic Redundancy Check (CRC) bits, convolutional encoding, data repetition and interleaving. Data repetition is used on subrate frames (half, quarter and eighth rate) after convolutional encoding resulting in a constant data rate on the air interface.

In CDMA communication systems the receiver does not know apriori the data rate of a received frame. The receiver has to apply the decoding mechanism for each of the allowable frame rates, and look at certain characteristics of the received data frames to determine the probable frame rate that the frame was transmitted at. Characteristics that are usually employed are Symbol Error Rate (SER), CRC verification and Viterbi decoder Quality bits. SER is an estimate of the number of symbol errors in the convolutionally coded data that is obtained by re-encoding the information sequence recovered by convolutional decoding and accumulating the number of re-encoded channel symbols found to be different from the received symbols. Some of the frame rates, namely full and half rate for IS-95, are protected by a CRC codeword. These are generated by the transmitter by performing a type of degenerate cyclic coding on the data. The resulting CRC is convolutionally encoded and transmitted with the data. The receiver also generates the CRC of the received convolutionally decoded data, and compares it with the CRC appended by the transmitter. Viterbi decoders are typically used for convolutional decoding. In addition to the decoded data sequence they sometimes provide a Quality bit indication that indicate whether a decoded sequence deviated excessively from a valid data sequence.

The decision as to what rate was employed by the transmitter is typically performed by the receiver's rate determiner utilizing a Rate Determination Algorithm (RDA). The determiner uses the decoding characteristics from each of the decoders to determine what rate the received frame was transmitted at and/or whether the frame is useable. If the frame contains too many bit errors or its rate cannot be determined the frame is declared an erasure. A RDA will typically have a series of rules that it follows to determine the rate. For example some such rules could be

```
IF CRC_full == TRUE AND SER_full <= SER_fullthreshold
    THEN FRAME_RATE = FULL
IF CRC_full == FALSE AND SER_full > SER_fullthreshold
    AND CRC_half == FALSE AND SER_half > SER_halfthreshold
    AND SER_eighth < SER_eighththreshold
    THEN FRAME_RATE = EIGHTH
```

Although RDAs typically do a good job of distinguishing between frame rates they are still subject to falsing. For example, a frame that was transmitted as an eighth rate frame can be incorrectly interpreted by the receiver as a full rate frame. The effects of these mis-determined rates can be severe, sometimes resulting in severe audio artifacts in voice calls and a reduction in data throughput for data calls. The falsing rate has been found to be dependant on many variable factors including the content of the frame being transmitted, interference conditions on the air interface and the performance of the receivers determiner. The FEC protocols used in IS-95 and known in the art have also been found to be non-optimal in providing adequate code distance between a transmitted subrate frame and the nearest possible full rate frame. For example, when presented with silence, the Enhanced Variable Rate Codec (EVRC) used in CDMA systems has been observed to converge on the 16 bit eighth rate frame 0740H, and repeat this frame over and over. Simulations of the IS-95 FEC scheme shows that this eighth rate when passed through the eighth rate convolutional encoder and data repeator, could be decoded by a full rate decoder with a very low SER. When the encoded frame is punctured by power control bits and suffers a few bit errors on the air interface it has been observed that the CRC can also pass. As shown by the determiner rules above, these conditions of a CRC pass and low SER are typically sufficient for the received frame to be declared a good full rate frame.

The severity of the resulting audio effects depend primarily on the contents of the received false full rate frame and whether they correspond to high audio gains, high frequencies etc after speech decoding. However, error mitigation techniques that are used to reduce the audio effects of air interface erasures have been found to also negatively affect the audio artifact.

Thus, there is a need for a method and apparatus for reducing rate determination errors and their audio effects in a communication system.

DETAILED DESCRIPTION OF THE PREFERRED EMBODIMENTS

The present invention provides a method and apparatus for improving the quality of an audio signal on a communication system. The method includes determining the validity of the frame rate of a speech frame and modifying the state of at least one speech decoder filter based on the validity determination. Applicable speech decoder filters include, but are not limited to, the pitch filter, the vocal tract filter and the post filter. The validity determination can be based on comparing the frame rate of the current frame with that of previously received frames. In particular if an eighth rate frame is received after a full rate frame that did not contain signaling information the frame is deemed to be invalid. The invention also allows for adjustment of symbol error thresholds based on the number of consecutive frames of the same frame rate. Adjusting these thresholds reduces the number of rate determination errors and hence improving the audio quality of the resulting speech.

The present invention provides an apparatus that includes means for determining the validity of a frame rate and a speech decoder capable of modifying, including reseting, its' filter states based on the validity determination. The present invention also provides means for adjusting symbol error thresholds based on the number of consecutive frames with the same frame rate.

Figure 1:
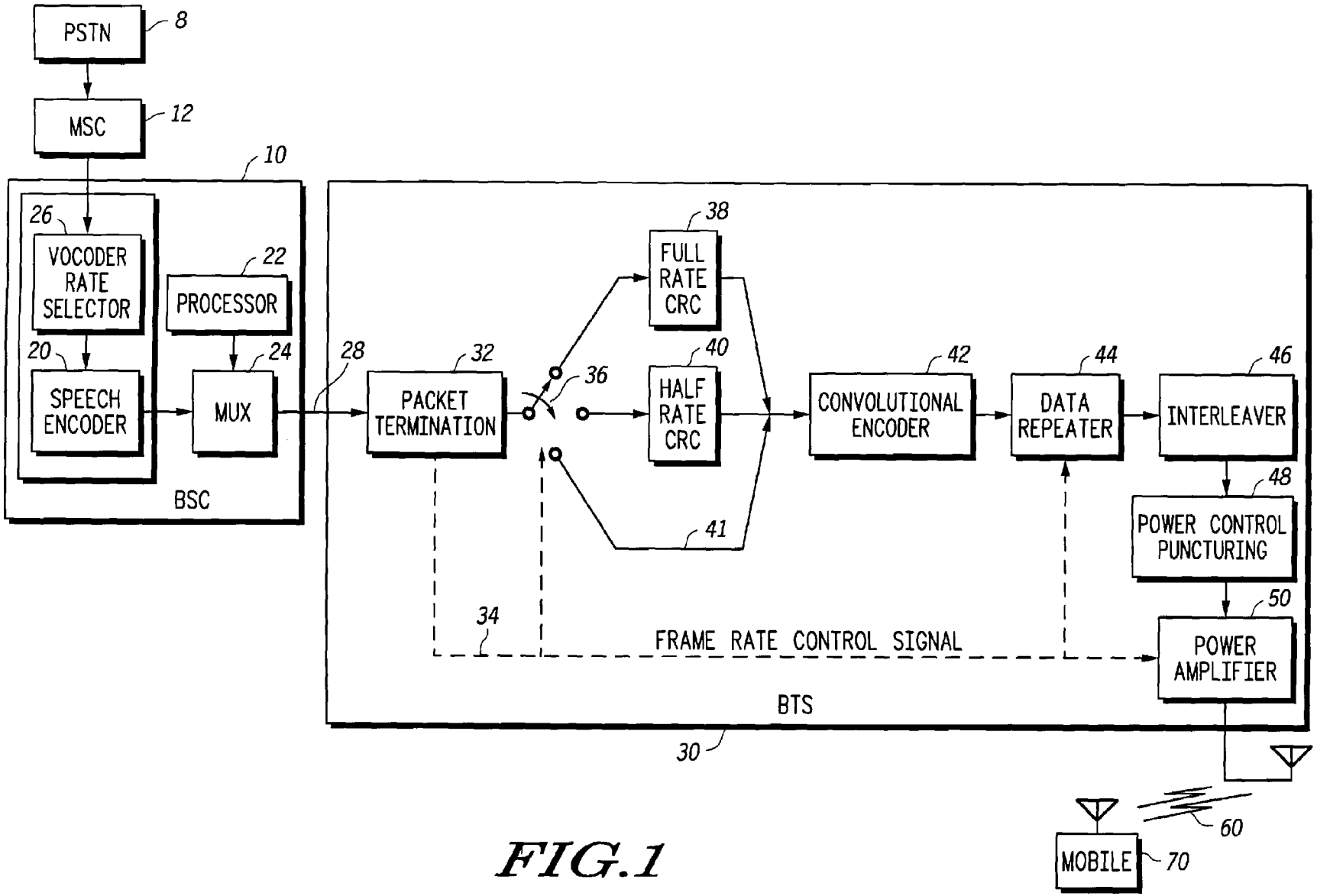
FIG. 1 is a block diagram of a wireless communication system.

FIG. 1 generally depicts a communication system in accordance with the preferred embodiment of the present invention. As shown in FIG. 1, a Base Site Controller (BSC) 10 is in communication with a Mobile Switching Center (MSC) 12 which is in turn in communication with the PSTN 8. In the preferred embodiment, the communication system is a Code Division Multiple Access (CDMA) cellular radiotelephone system, however it will be recognized by those of ordinary skill in the art that any suitable communication system may utilize the invention.

BSC 10 includes a speech encoder 20, a processor 22 and a multiplexer (MUX) 24. The speech encoder 20 receives speech samples at a data rate of 64 kbits/sec from the MSC 12 and uses speech compression algorithms such as Enhanced Variable Rate Codec (EVRC), that are well known in the art, to reduce the data rate. Speech Encoder 20 includes a rate selector 26, that selects the appropriate data rate for each 20mS portion of the received speech to be encoded at. The data rate of the resulting compressed speech frame is typically dependant on the level of speech activity within the sampled speech. In the case of EVRC there are three valid frame rates; full, half and eighth rate. Typically full rate frames are produced when active speech is occurring and eighth rate frames are produced during quiet periods. Half rate frames are typically produced during speech to quiet transitions or if commanded to by the MUX 24. For EVRC a full rate speech frame followed by an eighth rate speech frame is not allowed, hence all speech to quiet transitions include a half rate speech frame.

Processor 22 is responsible for generating and terminating signaling messages with the mobile unit 70. These signaling messages are multiplexed with the encoded speech frames from speech encoder 20 and with some additional control information by the MUX 24 to form full, half or eighth rate traffic frames. The additional control information includes a parameter specifying the traffic frame rate. The traffic frames are then sent via communication link 28 to the Base Transmitter Site (BTS) 30.

The traffic frames are received by the packet terminator 32, which generates a control signal 34 indicative of the traffic frame rate. A switch 36 controlled by the control signal 34 determines whether a full rate CRC 38, a half rate CRC 40 or no CRC 41 is appended to the traffic frame. The traffic frames are then passed through a ½ rate convolutional encoder 42 before being presented to the data repeater 44. The data repeater takes subrate frames, such as half and eighth rate frames, and upsamples them so that all frames contain the same number of bits. In the case of eighth rate frames every received bit is repeated seven times. Similarly every bit is repeated once for half rate frames. After the data repeater 42 every frame contains 384 bits.

The frames are then passed through a data interleaver 46 which scrambles the data in a predetermined order. This improves the resilience of the frame to burst errors on the air interface 60. 32 bits, in predetermined positions, within the frame are then replaced by power control information bits. This process is performed by the power control puncturing function 48. The resulting frame is passed to the power amplifier 50 for transmission over the air interface 60. The transmission power used for the frame is partly dependent on the control signal 34. The frame is then received, probably with bit errors, by the mobile unit 70.

Figure 2:
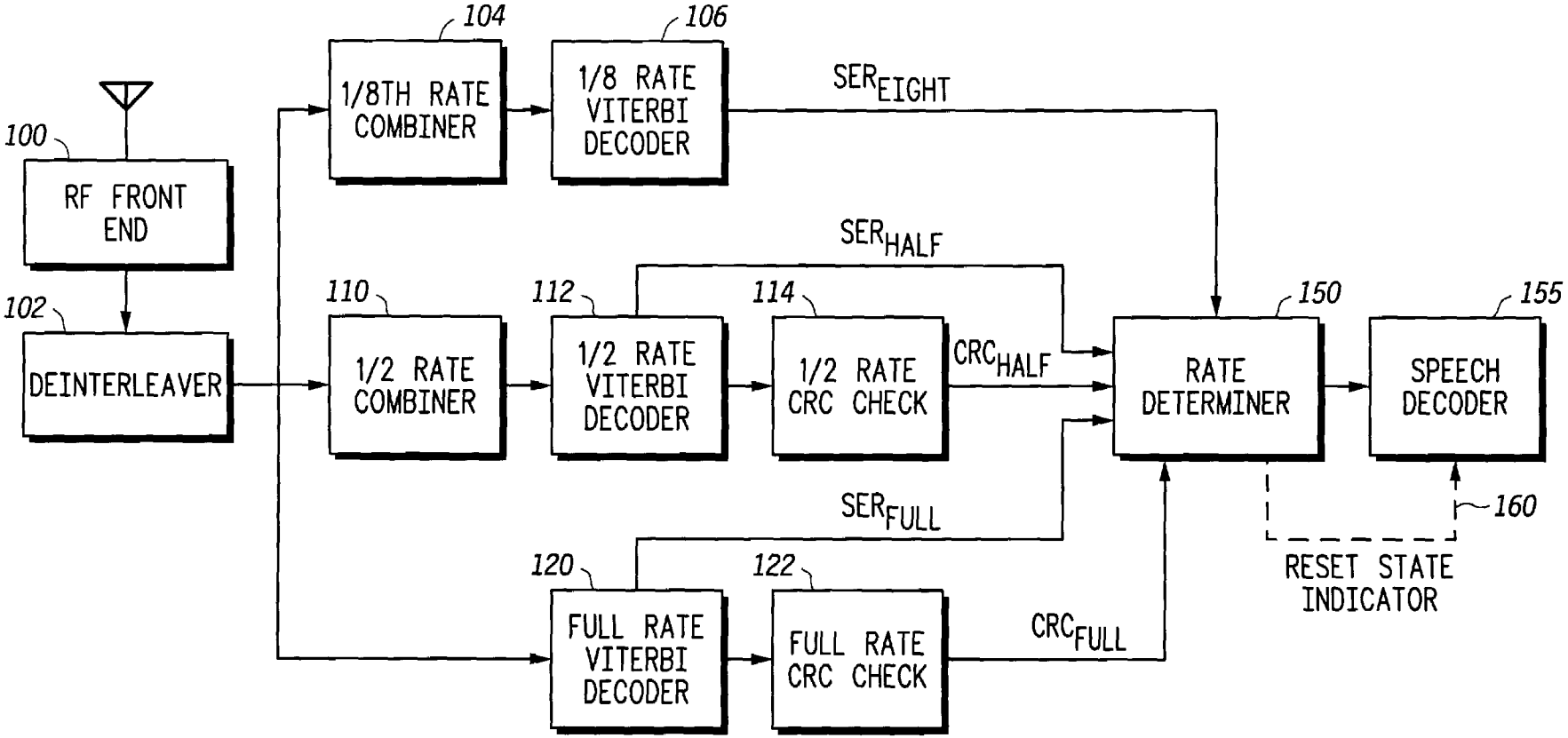
FIG. 2 is a block diagram of the error correction functions within a wireless unit in accordance with the preferred embodiment of the present invention.

FIG. 2 depicts the error correction functions within the mobile unit 70 of FIG. 1. The deinterleaver 102 receives 384 symbols from the RF front end 100. Each symbol is a confidence level of whether the corresponding transmitted bit was a 0 or a 1. These confidence levels are deemed soft decision values. For example in a 4 bit soft decision system a 0000 could represent very high probability that a transmitted bit was a 0 and 1111 could represent a very high probability that the bit was a 1. 1001 would suggest that the transmitted bit was a 1, but the confidence of the RF front end 100 is low. The deinterleaver 102 descrambles the symbols and presents the frame to multiple decode paths. A decode path exists for each possible traffic frame rate that the received frame could have been originally sent at by the MUX 24 of FIG. 1. The multiple decode paths are necessary because the receiver does not know apriori the traffic frame rate. In the case of EVRC there are three possible frame rates, full, half and eighth rate.

The eighth rate decode path consists of an $1/8^{th}$ rate combiner 104 and a convolutional decoder 106. The eighth rate combiner 104 combines each group of 8 consecutive symbols into one symbol to compensate for the data repetition introduced by the data repeater 44 of FIG. 1. The convolutional decoder 106, which is used to correct errors in the frame, outputs 16 data bits and an estimate of the Symbol Error Rate $SER_{eighth}$. The half rate decode path consists of a half rate combiner 110, a convolutional decoder 112 and a CRC check 114. The convolutional decoder 112 outputs 80 data bits, $SER_{half}$ and the received CRC. The CRC is checked by the CRC check 114 and the result $CRC_{half}$ is passed to the determiner's rate determination algorithm (RDA). The full rate decode path consists of a convolutional decoder 120 and a CRC check 122. The convolutional decoder 120 outputs 172 data bits, $SER_{full}$ and the received CRC. The CRC is checked by the CRC check 122 and the result $CRC_{full}$ is passed to the determiner 150. The determiner 150 determines the rate of the transmitted frame and selects the appropriate decoded frame for transmission to a speech decoder 155. The speech decoder 155 is responsible for decompressing the received speech frame using speech algorithms known in the art. The decompression algorithm is dependent on the frame rate.

The SER and CRC parameters as well as their use in determining the rate of a frame are well known in the art. However, as previously mentioned, the determiner 150 is prone to falsing and can sometimes mis-determine the rate of a frame. In accordance with the preferred embodiment of the invention the determiner 150 includes additional logic for reducing the mis-determinations and also for reducing the audio effects when mis-determinations occur. In accordance with the preferred embodiment of the present invention a control signal 160 from the determiner 150 to the speech decoder 155 is provided. The control signal 160 commands the speech decoder 155 to reset its internal digital filters when the determiner 150 believes that the previously received frame was mis-determined.

Figure 3:
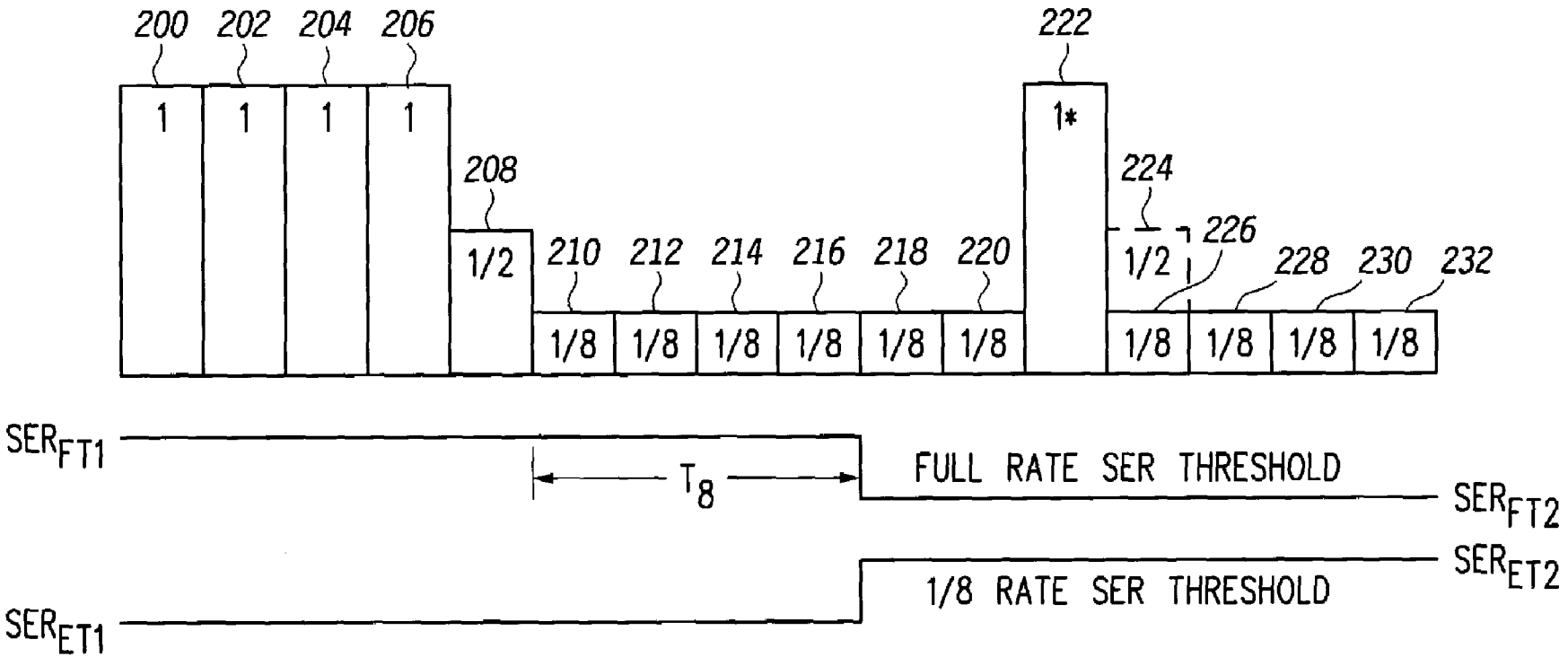
FIG. 3 is a diagram of a variable rate data stream in accordance with the preferred embodiment of the present invention.

For EVRC, as well as other variable rate vocoders known in the art, a direct transition from full rate to eighth rate is not allowed. The standards require that at least one half rate frame must be transmitted between any transition from full rate to eighth rate. FIG. 3 shows an example of a typical transition from full rate to eighth rate as well as a transition induced by a frame rate misdetermination. A series of full rate frames 200–206, corresponding to speech activity, were transmitted by the BTS 30 and correctly received by the determiner 150. During the transition to quiet a half rate frame 208 was generated by the speech encoder 20, to satisfy the rate transition rules imposed by the vocoder algorithm, and correctly received by the determiner 150.

Following the half rate frame 208, a series of eighth rate frames 210–220 is correctly received. Frame 222 was originally generated by the speech encoder 20 as an eighth rate frame but has been mis-determined by the determiner 150 as a full rate frame. When a frame rate is misdetermined by the determiner 150, the speech decoder 152 will be presented with a single full rate frame 222 after a series of eighth rate frames 210–220, followed by a second series of eighth rate frames 226–232. The speech decoder 152, however, requires that a half rate frame 224 is received between any full rate to eighth rate transition. As a result, the speech decoder 152 will declare the following valid eighth rate frame 226 as an erasure, as known in the art. In an alternative embodiment the determiner 150 may recognise the rate step down violation and declare the frame an erasure. The erasure forced by the vocoder algorithm has the effect of prolonging any audio anomoly produced from the original misdetermination since vocoder erasure processing as known in the art, involves utilizing parametric information from the frame received prior to the erasure frame. In the case of a misdetermination, the reused parameters originate from the corrupt misdetermined frame and thus the effect of the bad frame is extended.

An improved determiner 150 is introduced which is composed of two parts. The first part consists of adjusting the SER thresholds used by the determiner 150 based on the frame rate history. After a period of $T_8$ consecutive eighth rate frames, the SER threshold for full rate frames could be lowered from $SER_{FT1}$ to $SER_{FT2}$ requiring that subsequent full rate frames would have to be received with higher frame quality as measured by the $SER_{full}$ received from the full rate convolutional decoder 120. Additionally, the eighth rate SER threshold could be raised from $SER_{ET1}$ to $SER_{ET2}$ requiring that subsequent eighth rate frames could be received with lower frame quality as measured by the $SER_E$ received from the eighth rate convolutional decoder 106. The second part of the improved determiner 150 introduces a control path to the speech decoder 152 to allow for filter state cleanup within the vocoder algorithm. This is beneficial for minimizing the audio impact of any misdeterminations that persist.

Figure 4:
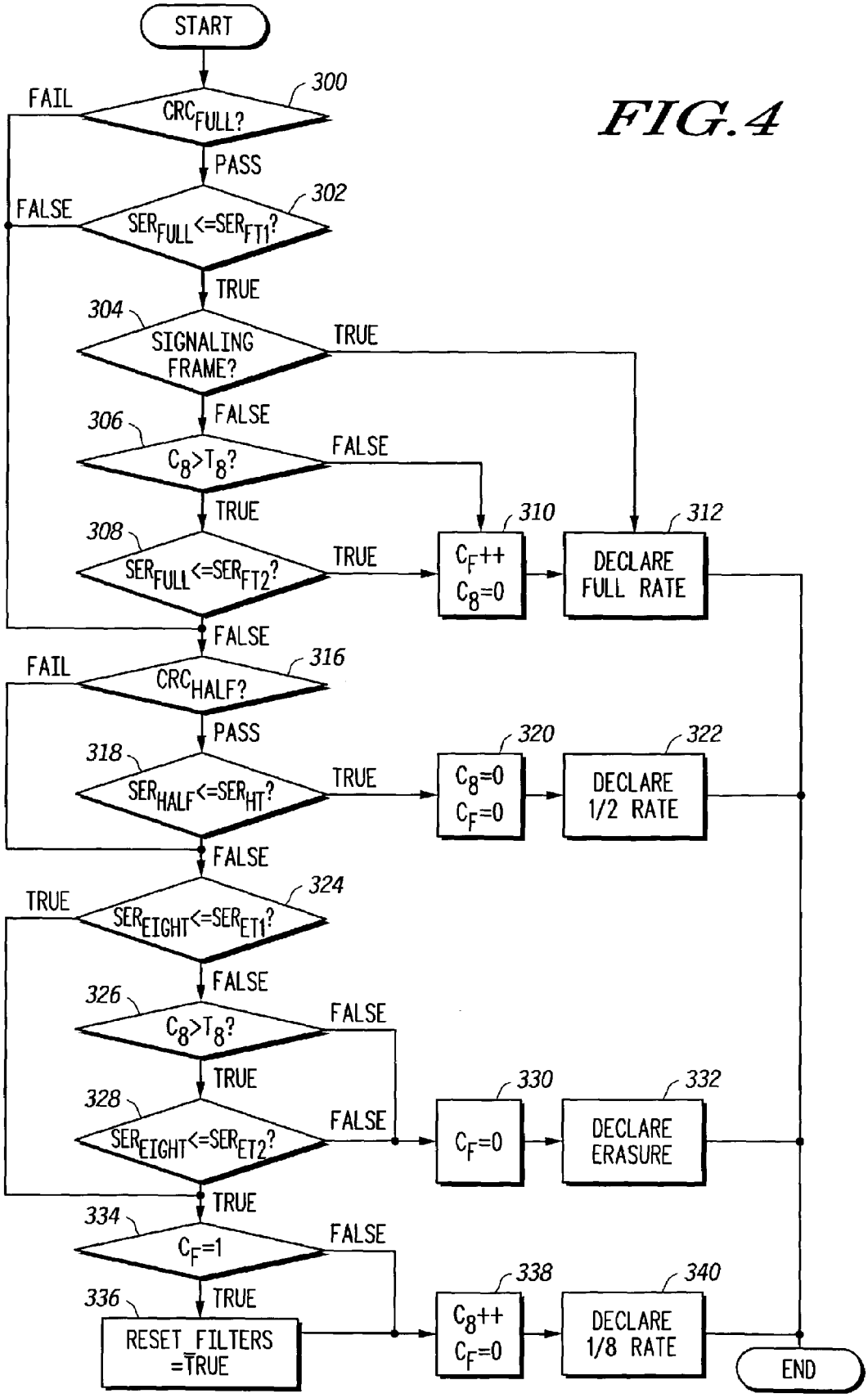
FIG. 4 is a flow diagram of the operation of a rate determination and error mitigation algorithm in accordance with the preferred embodiment of the present invention.

FIG. 4 is a flow diagram that shows more details of the operation of the improved determiner 150. We start at step 300 where the full rate CRC, received from full rate CRC check 122, is tested for a pass/fail condition. If the $CRC_{full}$ is determined to have failed the validity test, then the frame is removed from being a possible full rate frame candidate and the logic flow proceeds to step 316 to check for the validity of other frame rates. If the $CRC_{full}$ is determined to have passed the validity test, then the logic flow proceeds to step 302 where the $SER_{full}$ received from the full rate convolutional decoder 120, is evaluated. If the $SER_{full}$ exceeds the nominal threshold $SER_{FT1}$, then the frame is removed from being a possible full rate frame candidate and the logic flow proceeds to step 316 to check for the validity of other frame rates. If the $SER_{full}$ is less than or equal to the nominal threshold $SER_{FT1}$, then the logic flow proceeds to step 304 where the frame is evaluated to determine if it contains signaling traffic. This is necessary to prevent frames that contain critical call processing information in the form of signaling traffic to be subjected to the stricter $SER_{FT2}$ threshold test in step 308. For the IS-95B CDMA standard, this information is contained in the first few bits of the convolutionally decoded frame in the form of a mixed-mode bit (MM bit), a traffic type bit (TT bit), and a pair of traffic mode bits (TM bits). The definitions and usage of these bits is well known in the art.

Returning to step 304, if the frame is determined to contain signaling information, then the frame is considered as a valid full rate frame and the logic flow proceeds to step 312. If it is determined that the frame does not contain signaling information, then the logic flow proceeds to step 306 where the consecutive eighth rate frame counter $C_8$ is compared to the threshold $T_8$. If $C_8$ is greater the threshold $T_8$, then the stricter secondary SER threshold $SER_{FT2}$ is not checked and the logic flow proceeds to step 310 where the frame is declared to be a valid full rate frame. If $C_8$ is less than or equal to the threshold $T_8$, then the logic flow proceeds to step 308 where $SER_{full}$, received from the full rate convolutional decoder 120, is compared to the stricter secondary threshold $SER_{FT2}$. This secondary threshold is used to make it more difficult, in terms of allowed number of symbol errors, for a non-signaling full rate frame to be declared as valid. This requires that the first full rate frame or series of full rate frames following a interval of non-full rate frames have lower symbol error rate than is normally required.

If in step 308 $SER_{full}$ exceeds the threshold $SER_{FT2}$, then the frame is removed from consideration as a full rate frame and the logic flow proceeds to step 316 where other frame rates will be checked. If the $SER_{full}$ is less than or equal to $SER_{FT2}$, then the logic flow proceeds to step 310 where the consecutive eighth rate frame counter $C_8$ is reset to zero and the consecutive full rate counter is incremented. The logic flow continues to step 312 where the frame rate is set to be full rate.

If the frame could not be validated as a full rate frame, the logic flow will follow one of the paths to step 316 where the frame's half rate validity is considered. In step 316, the half rate CRC, received from half rate CRC check 114, is tested for a pass/fail condition. If the $CRC_{half}$ is determined to have failed the validity test, then the frame is removed from being a possible half rate frame candidate and the logic flow proceeds to step 324 to check for the validity of other frame rates. If the $CRC_{half}$ is determined to have passed the validity test, then the logic flow proceeds to step 318 where the $SER_{half}$, received from the full rate convolutional decoder 120, is evaluated. If $SER_{half}$ is less than or equal to the threshold $SER_{HT}$, then the logic flow proceeds to step 330 where the consecutive eighth rate frame and the consecutive full rate frame counters are reset to zero. The logic flow then proceeds to step 322 where the frame rate is set to be half rate. If in step 318, $SER_{half}$ exceeds the threshold $SER_{HT}$, then the frame is removed from consideration as a half rate frame and the logic flow proceeds to step 324 where other frame rates will be checked.

If the frame could not be validated as a full rate or half rate frame, then the logic flow will follow one of the paths leading to step 324. In step 324, $SER_{eighth}$, received from the eighth rate convolutional decoder, is evaluated. If $SER_{eighth}$ is less than or equal to the normal threshold $SER_{ET1}$, then the logic flow proceeds to step 334. If $SER_{eighth}$ exceeds the normal threshold $SER_{ET1}$, then the logic flow proceeds to step 326 where the consecutive eighth rate frame counter $C_8$ is compared to the threshold value $T_8$. If $C_8$ is less than or equal to $T_8$, then the logic flow proceeds to step 330 and the frame is declared as erasure since it could not adequately be qualified as either a full rate, half rate, or eighth rate frame. If $C_8$ exceeds the threshold $T_8$, then the logic flow proceeds to step 328 where $SER_{eighth}$ is compared against the relaxed threshold $SER_{ET2}$. If $SER_{eighth}$ exceeds the relaxed threshold $SER_{ET2}$, then the logic flow proceeds to step 330 where the consecutive full rate frame counter is reset to zero and then to step 332 where the frame is declared as an erasure frame. If $SER_{eighth}$ is less than or equal to the relaxed threshold $SER_{ET2}$, then the logic flow proceeds to declare the frame rate as eighth starting with step 334 where the value of the consecutive full rate counter is evaluated.

In this preferred embodiment, if the value of the full rate counter $C_F$ is set to a value of 1 indicating that only a single full rate frame was received prior to the current eighth rate frame, then the logic flow proceeds to step 336 where the vocoder filter reset indication is activated. This is due to the determination that the previously received frame was probably incorrectly declared to be a full rate frame. If CF is a value other than 1, then the logic flow skips step 336 and proceeds to step 338 where the consecutive full rate counter CF is reset to zero and the consecutive eighth rate counter is incremented. The logic flow continues to step 340 where the frame rate is declared to be eighth rate.

An alternative embodiment could use a weighted value of $SER_{full}$, and $SER_{eighth}$ to make a decision as to whether the full rate frame 222 or eighth rate frame 226 was misdetermined. In this case, the parameter $WSER_{full}$ and $WSER_{eighth}$ could be calculated and compared. For example, $WSER_{full}$ could be calculated as $WSER_{full}=W_{full}*SER_{full}$ and $WSER_{eighth}$ could be calculated as $WSER_{eighth}=W_{eighth}*SER_{eighth}$. If the value of $WSER_{full}$ exceeds the value of $WSER_{eighth}$, then the decision could be made that the misdetermined frame was the full rate frame 222 rather than the eighth rate frame 226 and the Reset_Filters flag could be set to TRUE. If the value of $WSER_{full}$ is less than or equal to $WSER_{eighth}$, then the decision could be made that the misdetermined frame was the current eighth rate frame 226 and declare the current eighth rate frame as an erasure without setting the Reset_Filters flag.

Figure 5:
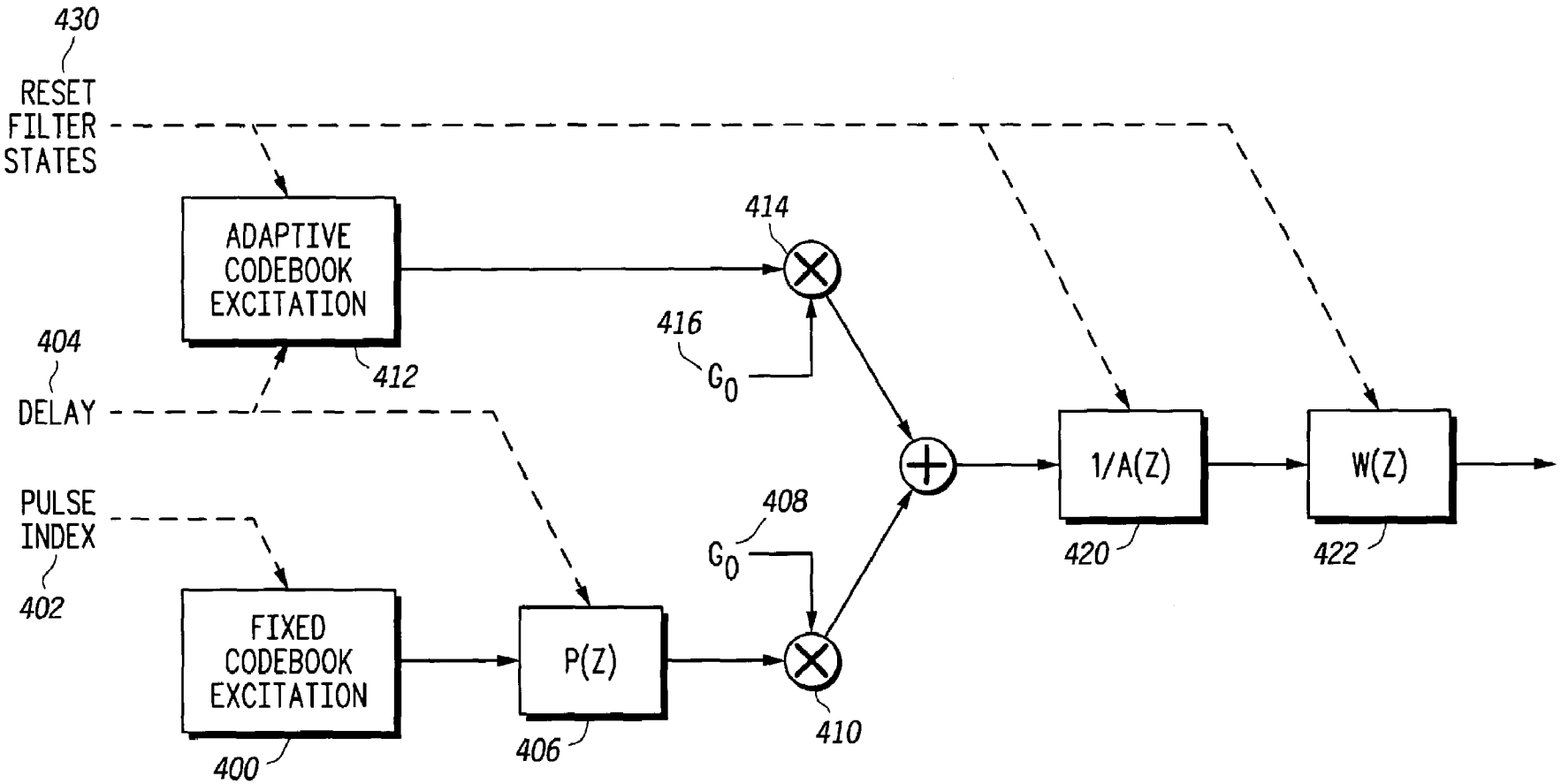
FIG. 5 is block diagram of a speech decoder reset mechanism in accordance with the preferred embodiment of the present invention.

A general vocoder algorithm implements a voice production model that generally consists of one or more digital filters. One possible model used in speech coders is the code-excited linear prediction model (CELP) in which many algorithms known in the art are based. One such vocoder algorithm that is based on the CELP model is the EVRC vocoder algorithm. FIG. 5 depicts the voice generation components of the EVRC speech decoder, however, it will be recognized by those of ordinary skill in the art that any suitable speech decoder may utilize the invention. The excitation signal sequence is constructed of a fixed excitation 400 and an adaptive excitation 412 which create their respective excitation components based, in part, on parameters transmitted within the speech frame as well as information from earlier decoded frames. The fixed codebook excitation 400 is regenerated by the speech decoder based on a multi-pulse excitation scheme. The pulse information 402 is converted, by the fixed codebook excitation 400, into a corresponding excitation sequence consisting of several pulses at predefined intervals. This sequence is then filtered 406 using a single tap finite impulse response (FIR) filter to enhance the pitch performance of the excitation sequence. The resulting sequence is then multiplied 410 by a gain factor 408 to create the overall fixed-excitation sequence. The adaptive codebook excitation 412 is responsible for generating the pitch component of the speech model. This excitation is created by the speech decoder from a history of prior combined excitation samples and utilizing the pitch period delay parameter transmitted in the speech frame. The resulting sequence is then multiplied 414 by a gain parameter 416, which is transmitted as part of the speech frame, to create the overall adaptive codebook component of the excitation sequence. The two excitation components are then added together 418 to create the overall excitation sequence. Once the overall excitation sequence is created, it is then filtered using an all-pole filter 1/A(Z) 420 which models the vocal tract of the human speech production system. The resulting synthesized speech sequence is then filtered by a post-filter W(Z) 422 which is designed to enhance the perceptual quality of the synthesized speech sequence.

FIG. 5 shows how the filter reset control, received from the enhanced determiner 150, can be used to reset the filter states in order to mitigate the audio impact of the misdetermined frame. When the filter reset indication 430 is received from the determiner 150, the speech decoder will reset the states of the various filters 412/420/422. This operation ensures that the effects of the original misdetermination are not extended into subsequent frames through erasure processing and filter state memories.

The adaptive codebook excitation 412 contains a pitch filter that is used to generate the pitch component of the synthesized speech sequence. This filter consists of a memory of past combined excitation samples that are cleared when the filter reset indication 430 is received. The vocal tract filter 420 and the post-filter 422 also contain some filter memory that could extend the audio impact beyond the initial misdetermination, so these filters are also reset. Note that it is not necessary to reset the fixed codebook pitch enhancement filter since no memory from prior frames is utilized. In addition to the filter reset operation, the speech decoder could disregard the imposed rate transition rules based on the knowledge that the prior full rate frame was decoded, by the determiner 150, in error.

The filter reset control operation has been described in terms of the preferred embodiment, however, one alternative embodiment could additionally reset the excitation gain parameters 408/416 and allow normal enforcement of the rate transition rules. By resetting the gain parameters 408/416, the speech decoder could mitigate the audio impact of the misdetermination and the rate transition induced erasure processing by ensuring that the excitation signal presented to the vocal tract filter 420 is effectively nullified.

Another alternative embodiment could be to initialize the filters 412/420/422 with states that will produce a more perceptually pleasing transition between the audio produced by the misdetermined frame and the expected background signal. One such filter state initialization could be to reload the filter states to the states that existed prior to the frame misdetermination.

Figure 6:
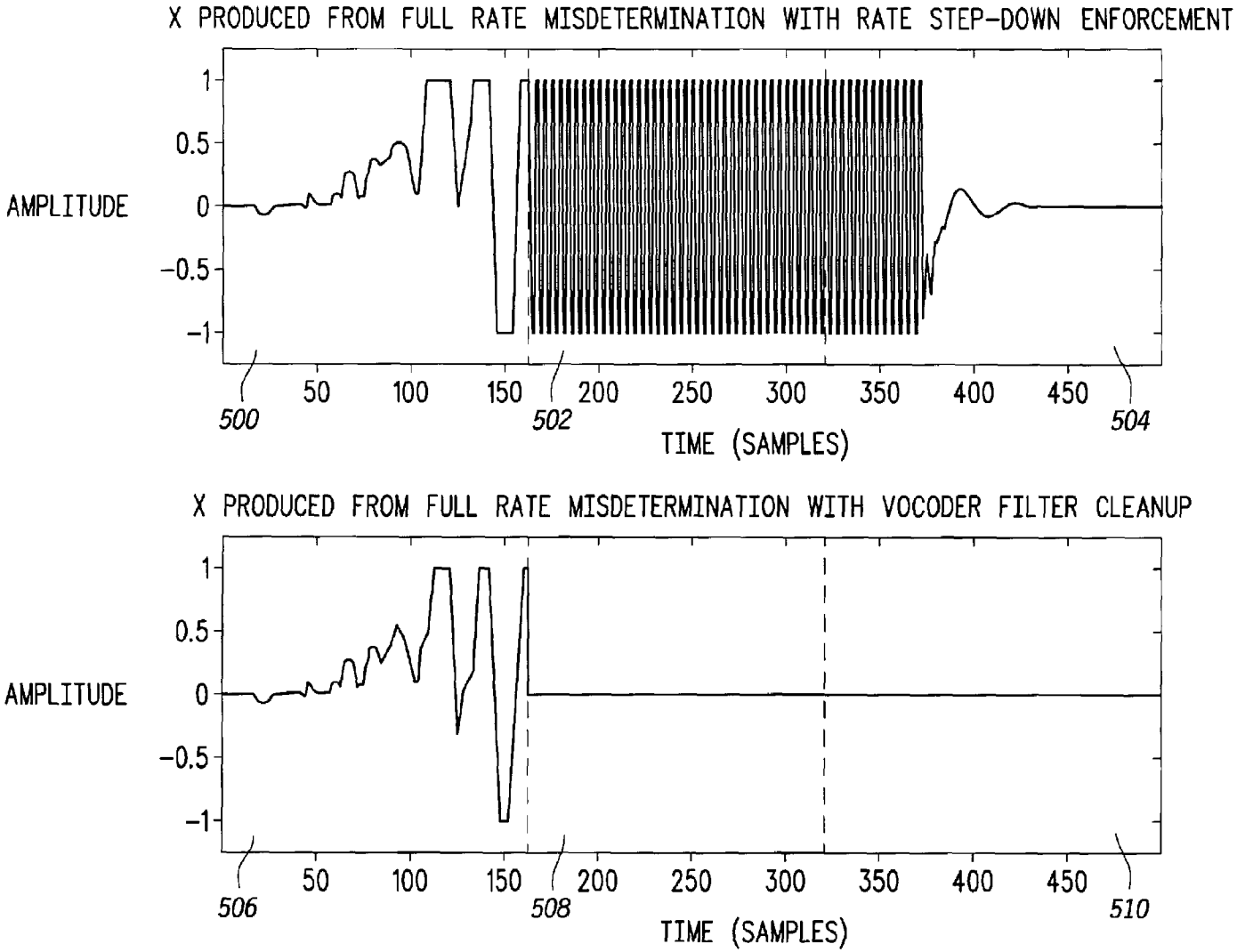
FIG. 6 is a diagram illustrating the audio artifacts incurred after a mis-determination with and without the preferred embodiment of the present invention.

FIG. 6 illustrates the improvement in audio impact that is realized by the artifact mitigation portion of the invention. Each plot is composed of a timeline containing three speech frames. The first plot illustrates the audio impact of a full rate frame misdetermination when the artifact mitigation scheme is not utilized. The three speech frames consist of a frame for the misdetermined frame 500, a frame for the erasure processing induced by the rate transition rule 502, and a frame for the prolonged effects of the filter state memories 504.

The second plot illustrates the audio improvement realized by utilizing the artifact mitigation scheme according to the preferred embodiment of the invention. The first frame 506 shows the effects of a misdetermination that escaped the RDA detection phase. The second 508 and third frames 510 show how the effect of the escaped misdetermination is contained by resetting the filter states and allowing the speech decoder to disregard the rate transition rule for detected misdeterminations. This results in an overall improvement in artifact duration and produces a less objectionable audio impact to the human receiver.

The invention has been described in terms of several preferred embodiments. These preferred embodiments are meant to be illustrative of the invention, and not limiting of its broad scope, which is set forth in the following claims.

The invention claimed is:

1. A method comprising the steps of:

receiving a first frame;

determining a first frame rate for the first frame;

decoding the first frame according to the first frame rate to produce a speech decoder filter state;

receiving a second frame;

determining a second frame rate for the second frame;

determining, based on the second frame rate, if the first frame rate was in error to produce an error determination;

updating the speech decoder filter state based on the error determination to produce an updated speech decoder filter state;

decoding the second frame using the updated speech decoder filter state, wherein the step of determining, based on the second frame rate, if the first frame rate was in error comprises the step of determining if a transition from the first frame rate to the second frame rate was invalid for not conforming to pre-defined, vocoder, rate-transition rules.

2. The method of claim 1 wherein the step of determining, based op the second frame rate, if the first frame rate was in error comprises the step of determining that the first frame rate was in error when the first frame rate is determined to be a full rate frame and the second frame rate is determined to be an $8^{th}$ rate frame.

3. The method of claim 1 wherein the step of determining if the first frame rate was in error comprises the step of determining if the first frame was a signaling frame.

4. The method of claim 3, wherein the step of determining if the first frame rate was in error comprises the step of determining that the first frame rate was not in error, if the first frame was determined to be a signaling frame.

5. The method of claim 1 wherein the step of determining the first frame rate and the second frame rate comprises the step of determining frame rates from a group consisting of full, half, quarter, and eighth frame rates.

6. The method of claim 1 wherein the step of updating the speech decoder filter state comprises the step of resetting the state of the speech decoder filter.

7. The method of claim 1 wherein the step of updating the speech decoder filter state comprises the step of updating the state of a filter from a group consisting of a pitch filter, a vocal tract filter, and a post filter.

8. The method of claim 1 wherein the step of updating the speech decoder filter state comprises the step of resetting excitation memory.

9. The method of claim 1 wherein the step of updating the speech decoder filter state comprises the step of resetting a postfilter synthesis memory.

10. The method of claim 1 wherein the step of updating the speech decoder filter state comprises the step of resetting a vocal tract filter memory.

11. An apparatus comprising:

means for determining a first frame rate for a first frame;

means for decoding the first frame according to the first frame rate to produce a speech decoder filter state;

means for determining a second frame rate for a second frame;

means for determining, based on the second frame rate, if the first frame rate was in error to produce an error determination;

means for updating the speech decoder filter state based on the error determination to produce an updated speech decoder filter state;

means for decoding the second frame using the updated speech decoder filter state, wherein the means for determining, based on the second frame rate, if the first frame rate was in error comprises means for determining if a transition from the first frame rate to the second frame rate was invalid for not conforming to pre-defined, vocoder, rate-transition rules.

12. The apparatus of claim 11 wherein the means for determining, based on the second frame rate, if the first frame rate was in error comprises means for determining that the first frame rate was in error when the first frame rate is determined to be a full rate frame and the second frame rate is determined to be an $8^{th}$ rate frame.

13. The apparatus of claim 11 wherein the means for updating the speech decoder filter state comprises means for resetting an excitation memory.

14. The apparatus of claim 11 wherein the means for updating the speech decoder filter state comprises means for resetting a postfilter synthesis memory.

* * * * *